US011189229B2

(12) United States Patent
Park et al.

(10) Patent No.: US 11,189,229 B2
(45) Date of Patent: Nov. 30, 2021

(54) DISPLAY DEVICE AND DRIVING METHOD THEREOF

(71) Applicant: Samsung Display Co., Ltd., Yongin-si (KR)

(72) Inventors: Jung Kook Park, Yongin-si (KR); Dong Wan Park, Yongin-si (KR); Sang Min Lim, Yongin-si (KR)

(73) Assignee: Samsung Display Co., Ltd., Yongin-si (KR)

( * ) Notice: Subject to any disclaimer, the term of this patent is extended or adjusted under 35 U.S.C. 154(b) by 0 days.

(21) Appl. No.: 16/681,551

(22) Filed: Nov. 12, 2019

(65) Prior Publication Data

US 2020/0152129 A1 May 14, 2020

(30) Foreign Application Priority Data

Nov. 12, 2018 (KR) ..... 10-2018-0138289

(51) Int. Cl.

| | |
|---|---|
| ***G09G 3/3258*** | (2016.01) |
| ***G09G 3/3225*** | (2016.01) |
| ***G09G 3/3208*** | (2016.01) |
| ***G09G 3/36*** | (2006.01) |

(52) U.S. Cl.

CPC ..... *G09G 3/3258* (2013.01); *G09G 3/3208* (2013.01); *G09G 3/3225* (2013.01); *G09G 3/3611* (2013.01); *G09G 2310/027* (2013.01); *G09G 2320/0633* (2013.01)

(58) Field of Classification Search

CPC .. G09G 3/3208; G09G 3/3225; G09G 3/3258; G09G 3/3611; G09G 2320/0238; G09G 2320/0233; G09G 2320/0214; G09G 2320/02; G09G 2320/0633; G09G 2310/027; G09G 2310/0264

USPC ..... 345/76, 204

See application file for complete search history.

(56) References Cited

U.S. PATENT DOCUMENTS

| | | | | |
|---|---|---|---|---|
| 8,766,966 | B2 * | 7/2014 | Kawashima | G09G 3/3233 345/212 |
| 2008/0252653 | A1 * | 10/2008 | Alessi | G09G 3/3208 345/589 |
| 2011/0316838 | A1 | 12/2011 | Ahn | |
| 2015/0248862 | A1 * | 9/2015 | Lee | G09G 3/2022 345/78 |
| 2018/0090067 | A1 * | 3/2018 | Oh | G09G 3/3233 |
| 2019/0130827 | A1 | 5/2019 | Pyo et al. | |

FOREIGN PATENT DOCUMENTS

| | | | |
|---|---|---|---|
| KR | 10-2012-0001470 | A | 1/2012 |
| KR | 10-2017-0066771 | A | 6/2017 |
| KR | 10-2019-0049977 | A | 5/2019 |

* cited by examiner

*Primary Examiner* — Jimmy H Nguyen

(74) *Attorney, Agent, or Firm* — Lewis Roca Rothgerber Christie LLP

(57) ABSTRACT

A display device includes: a display panel including a plurality of pixels; a data driver configured to supply a black voltage to the display panel; and a controller configured to: set an initial driving power voltage of the display panel; decide a bright spot voltage of the display panel while the data driver is supplying the black voltage to the display panel; and set any one of the bright spot voltage and the initial driving power voltage as a final driving power voltage.

10 Claims, 6 Drawing Sheets

DISPLAY DEVICE AND DRIVING METHOD THEREOF

CROSS-REFERENCE TO RELATED APPLICATION

This application claims priority to and the benefit of Korean patent application 10-2018-0138289 filed on Nov. 12, 2018 in the Korean Intellectual Property Office, the entire disclosure of which is incorporated herein by reference.

BACKGROUND

1. Field

The present disclosure generally relates to a display device and a driving method thereof.

2. Related Art

A driving power voltage of a general display panel may be determined based on luminance and chromaticity of the display panel. Accordingly, a low potential driving power voltage may decrease when luminance required in the display panel increases and high reliability is required.

However, when the low potential driving power voltage decreases, a bright spot may occur, where a luminance corresponding to a black grayscale increases due to a leakage current. As a result, image quality may be deteriorated.

The Background section of the present Specification includes information that is intended to provide context to example embodiments, and the information in the present Background section does not necessarily constitute prior art.

SUMMARY

Some example embodiments may include a display device that determines a driving power voltage of a display panel by considering a bright spot, and a driving method of the display device.

Some example embodiments may also include a display device that decides a bright spot voltage from the result obtained by measuring a pixel current for each driving power voltage or black voltage and determines a driving power voltage of a display panel from the decided bright spot voltage, and a driving method of the display device.

According to some example embodiments of the present disclosure, a display device includes: a display panel including a plurality of pixels; a data driver configured to supply a black voltage to the display panel; and a controller configured to set an initial driving power voltage of the display panel, decide a bright spot voltage of the display panel while the data driver is supplying the black voltage to the display panel, and set any one of the bright spot voltage and the initial driving power voltage as a final driving power voltage.

The controller may change a driving power voltage in a preset unit within a threshold range while the data driver is supplying the black voltage to the display panel, and measure a current of the display panel, corresponding to each of the changed driving power voltages.

The threshold range may include the initial driving power voltage.

The initial driving power voltage may be determined by luminance and chromaticity of the display panel.

The controller may change the black voltage in a preset unit within a threshold range while the data driver is supplying the black voltage to the display panel, and measure a current of the display panel, corresponding to each of the changed black voltages.

The controller may determine a reference current according to the driving power voltage, and decide, as the bright spot voltage, a driving power voltage when the difference between the reference current and the measured current exceeds a preset threshold value, by comparing the reference current and the measured current.

When the measured current is approximated to an arbitrary quadratic equation, the reference current may be defined by a tangent line of the quadratic equation at the initial driving power voltage.

The controller may set, as the final driving power voltage, a large voltage between the initial driving power voltage and the bright spot voltage.

The driving power voltage may be a low-potential voltage.

According to some example embodiments of the present disclosure, in a method for driving a display device having a display panel including a plurality of pixels, the method includes: setting an initial driving power voltage of the display panel; deciding a bright spot voltage by supplying a black voltage and a driving power voltage to the display panel; and setting any one of the bright spot voltage and the initial driving power voltage as a final driving power voltage.

The deciding of the bright spot voltage may include: changing the driving power voltage in a preset unit within a threshold range while the black voltage is being supplied to the display panel; and measuring a current of the display panel, corresponding to each of the changed driving power voltages.

The threshold range may include the initial driving power voltage.

The initial driving power voltage may be determined based on luminance and chromaticity of the display panel.

The deciding of the bright spot voltage may include: changing the black voltage in a preset unit within a threshold range while the black voltage is being supplied to the display panel; and measuring a current of the display panel, corresponding to each of the changed black voltages.

The deciding of the bright spot voltage may include: determining a reference current according to the driving power voltage; comparing the reference current and the measured current; and deciding, as the bright spot voltage, a driving power voltage when the difference between the reference current and the measured current exceeds a preset threshold value, based on the comparison result.

The determining of the reference current may include: approximating the measured current to an arbitrary quadratic equation; and defining the reference current, based on a tangent line of the quadratic equation at the initial driving power voltage.

The setting of the final driving power voltage may include: comparing the initial driving power voltage and the bright spot voltage; when the initial driving power voltage is larger than the bright spot voltage, setting the initial driving power voltage as the final driving power voltage; and when the bright spot voltage is larger than the initial driving power voltage, setting the bright spot voltage as the final driving power voltage.

The driving power voltage may be a low-potential voltage.

BRIEF DESCRIPTION OF THE DRAWINGS

Aspects of some example embodiments will now be described more fully hereinafter with reference to the accompanying drawings; however, they may be embodied in different forms and should not be construed as limited to the example embodiments set forth herein. Rather, these example embodiments are provided so that this disclosure will be more thorough and more complete, and will more fully convey the scope of the example embodiments to those skilled in the art.

In the drawing figures, dimensions may be exaggerated for clarity of illustration. It will be understood that when an element is referred to as being "between" two elements, it can be the only element between the two elements, or one or more intervening elements may also be present. Like reference numerals refer to like elements throughout.

DETAILED DESCRIPTION

Figure 1:
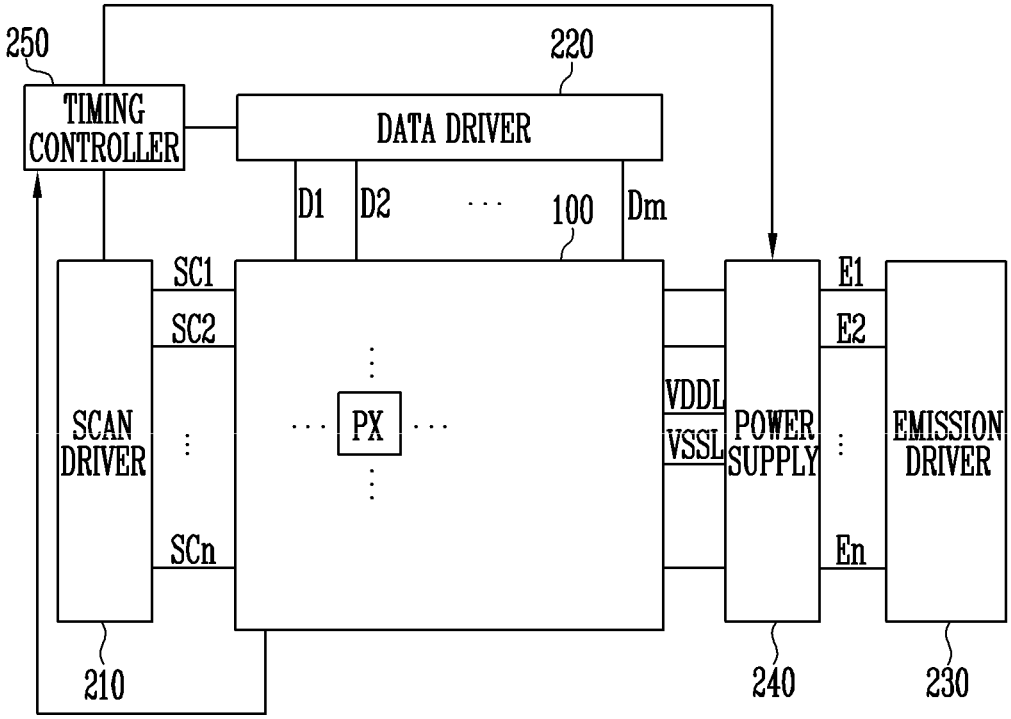
FIG. 1 is a block diagram illustrating a display device according to some example embodiments of the present disclosure.

The characteristics and features of some example embodiments of the present invention, and the way of attaining them, will become more apparent with reference to embodiments described below in conjunction with the accompanying drawings. However, the present disclosure is not limited to the example embodiments but may be implemented into different forms. These example embodiments are provided only for illustrative purposes and for a more full understanding of the scope of some example embodiments of the present disclosure by those skilled in the art.

In the entire specification, when an element is referred to as being "connected" or "coupled" to another element, it can be directly connected or coupled to the another element or be indirectly connected or coupled to the another element with one or more intervening elements interposed therebetween. It should be noted that, in giving reference numerals to elements of each drawing, like reference numerals refer to like elements even though like elements are shown in different drawings.

FIG. 1 is a block diagram illustrating a display device according to some example embodiments of the present disclosure.

Referring to FIG. 1, the display device according to some example embodiments of the present disclosure may include a display panel 100 including a plurality of pixels PX, a scan driver 210, a data driver 220, an emission driver 230, a power supply 240, and a controller (e.g., a timing controller) 250.

The controller 250 may generate a scan driving control signal, a data driving control signal, an emission driving control signal, and a power driving control signal, based on signals input from the outside. The scan driving control signal generated by the controller 250 may be supplied to the scan driver 210, the data driving control signal generated by the controller 250 may be supplied to the data driver 220, the emission driving control signal generated by the controller 250 may be supplied to the emission driver 230, and the power driving control signal generated by the controller 250 may be supplied to the power supply 240.

The scan driving control signal may include a plurality of clock signals and a scan start signal. The scan start signal may control an output timing of a first scan signal. The clock signals may be used to shift the scan start signal.

The data driving control signal may include a source start pulse and clock signals. The source start pulse may control a sampling start time of data, and the clock signals may be used to control a sampling operation.

The emission driving control signal may include an emission start pulse and clock signals. The emission start pulse may control a first timing of an emission control signal. The clock signals may be used to shift the emission start pulse.

The power driving control signal may include information on a first driving power source VDD and a second driving power source VSS. In various embodiments of the present disclosure, the controller 250 may decide a bright spot voltage by measuring a change in current of the display panel 100 according to the second driving power source VSS or a black voltage during the display panel 100 is displaying a black grayscale. The controller 250 may determine an optimum second driving power source VSS from the bright spot voltage, and provide the power supply 240 with information on the second driving power source VSS determined through the power driving control signal.

Meanwhile, although an embodiment in which the controller 250 fixes the first driving power source VDD and controls the second driving power source VSS is described in the present disclosure, the embodiments of the present disclosure are not limited thereto.

The scan driver 210 may output a scan signal, corresponding to the scan driving control signal. The scan driver 210 may sequentially supply the scan signal to scan lines SC1 to SCn. The scan signal may be set to a gate-on voltage (e.g., a high-level voltage) at which transistors included in the pixels PX can be turned on.

The data driver 220 may supply a data signal to data lines D1 to Dm, corresponding to the data driving control signal. The data signal supplied to the data lines D1 to Dm may be supplied to the pixels PX to which the scan signal is supplied. To this end, the data driver 220 may supply the data signal to the data lines D1 to Dm to be synchronized with the scan signal.

The emission driver 230 may supply an emission control signal to emission control lines E1 to En, corresponding to the emission driving control signal. The emission control signal may be used to control an emission time of the pixels PX. For example, a specific pixel PX supplied with the emission control signal may be set to an emission state during a period in which the emission control signal is supplied, and be set to a non-emission state during the other periods.

The power supply 240 may supply a driving power source to each of the pixels PX included in the display panel 100, based on the power driving control signal. The power supply 240 may supply the first driving power source VDD through a first power line VDDL, and supply the second driving power source VSS through a second power line VSS. The first driving power source VDD may be set to a high-potential voltage, and the second driving power source VSS may be set to a low-potential voltage.

The display panel 100 may include a plurality of pixels PX coupled to the data lines D1 to Dm, the scan lines SC1 to SCn, and the emission control lines E1 to En. The pixels PX may be supplied with the first driving power source VDD and the second driving power source VSS from the power supply 240.

Each of the pixels PX may be supplied with a data signal from a corresponding data line among the data lines D1 to Dm when a scan signal is supplied to a corresponding scan line coupled thereto among the scan lines SC1 to SCn. The pixel PX supplied with the data signal may control an amount of current flowing from the first driving power source VDD to the second driving power source VSS via a light emitting device (not shown), corresponding to the data signal.

The light emitting device may generate light with a predetermined luminance, corresponding to the amount of current. Additionally, the first driving power source VDD may be set to a voltage higher than that of the second driving power source VSS.

Figure 2:
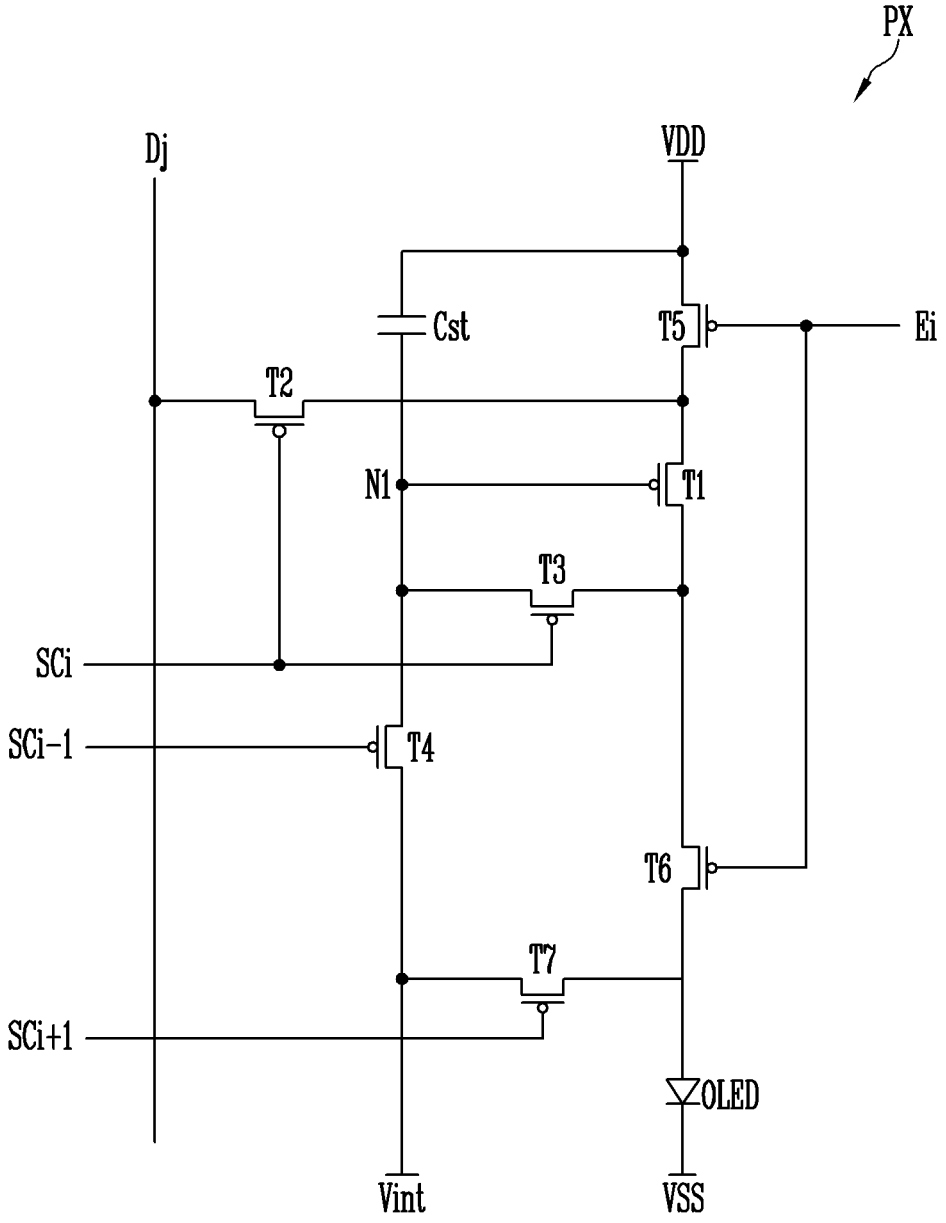
FIG. 2 is a diagram illustrating an embodiment of a pixel shown in FIG. 1.

FIG. 2 is a diagram illustrating an example embodiment of the pixel shown in FIG. 1. For convenience of description, a pixel PX coupled to an ith scan line SCi, an (i−1)th scan line SCi−1, an (i+1)th scan lines SCi+1, and a jth data line Dj is illustrated in FIG. 2.

The pixel PX may include a light emitting device OLED, first to seventh transistors T1 to T7, and a storage capacitor Cst.

One end portion of the light emitting device OLED is coupled to the first transistor T1 via the sixth transistor T6, and the other end portion of the light emitting device OLED is coupled to the second driving power source VSS. The light emitting device OLED generates light with a luminance (e.g., a predetermined luminance) corresponding to an amount of current supplied from the first transistor T1.

A source electrode of the first transistor (driving transistor) T1 is coupled to the first driving power source VDD via the fifth transistor T5, and a drain electrode of the first transistor T1 is coupled to the one end portion of the light emitting device OLED via the sixth transistor T6. The first transistor T1 controls an amount of current flowing from the first driving power source VDD to the second driving power source VSS via the light emitting device OLED, corresponding to a voltage of a first node N1 that is a gate electrode thereof.

The second transistor T2 is coupled between the jth data line Dj and the source electrode of the first transistor T1. In addition, a gate electrode of the second transistor T2 is coupled to the ith scan line SCi. The second transistor T2 is turned on when a scan signal is supplied to the ith scan line SCi, to electrically couple the jth data line Dj and the source electrode of the first transistor T1 to each other.

The third transistor T3 is coupled between the drain electrode of the first transistor T1 and the first node N1. In addition, a gate electrode of the third transistor T3 is coupled to the ith scan line SCi. The third transistor T3 is turned on when a scan signal is supplied to the ith scan line SCi, to electrically couple the drain electrode of the first transistor T1 and the first node N1 to each other. Therefore, the first transistor T1 is diode-coupled when the third transistor T3 is turned on.

The fourth transistor T4 is coupled between the first node N1 and an initialization power source Vint. In addition, a gate electrode of the fourth transistor T4 is coupled to the (i−1)th scan line SCi−1. The fourth transistor T4 is turned on when a scan signal is supplied to the (i−1)th scan line SCi−1, to supply the voltage of the initialization power source Vint to the first node N1. The initialization power source Vint is set to a voltage lower than a data signal.

The fifth transistor T5 is coupled between the first driving power source VDD and the source electrode of the first transistor T1. In addition, a gate electrode of the fifth transistor T5 is coupled to an ith emission control line Ei. The fifth transistor T5 is turned off when an emission control signal is supplied to the ith emission control line Ei, and is turned on otherwise.

The sixth transistor T6 is coupled between the drain electrode of the first transistor T1 and the one end portion of the light emitting device OLED. In addition, a gate electrode of the sixth transistor T6 is coupled to the ith emission control line Ei. The sixth transistor T6 is turned off when an emission control signal is supplied to the ith emission control line Ei, and is turned on otherwise.

The seventh transistor T7 is coupled between the initialization power source Vint and the one end portion of the light emitting device OLED. In addition, a gate electrode of the seventh transistor T7 is coupled to the (i+1)th scan line SCi+1. The seventh transistor T7 is turned on when a scan signal is supplied to the (i+1)th scan lines SCi+1, to supply the voltage of the initialization power source Vint to the one end portion of the light emitting device OLED.

The storage capacitor Cst is coupled between the first driving power source VDD and the first node N1. The storage capacitor Cst stores a voltage corresponding to the data signal and a threshold voltage of the first transistor T1.

Figure 3:
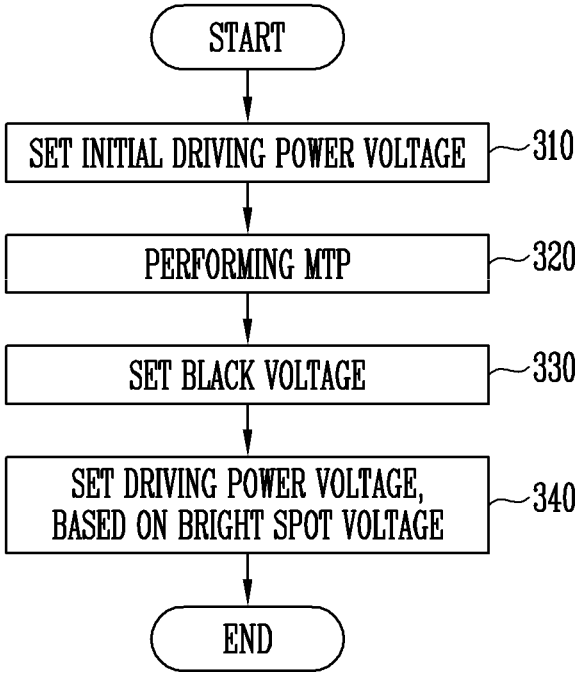
FIG. 3 is a flowchart illustrating a driving method of the display device according to some example embodiments of the present disclosure.

FIG. 3 is a flowchart illustrating a driving method of the display device according to some example embodiments of the present disclosure.

Referring to FIGS. 1 and 3, the display device according to some example embodiments of the present disclosure sets an initial driving power voltage of the display panel 100 (310). The initial driving power voltage may include a voltage (hereinafter, referred to as a first driving power voltage) of the first driving power source VDD and a voltage (hereinafter, referred to as a second driving power voltage) of the second driving power source VSS.

The initial driving power voltage may be set based on luminance and chromaticity of the display panel 100. The luminance and chromaticity of the display panel 100 may be determined by a kind of display device, specifications, a size of the display panel 100, etc. The initial driving power voltage may be set by a manufacturer of the display device, etc.

Next, the display device performs multi time programming (MTP) (320). For example, the display device may program, in real time, a reference gamma voltage to fit the luminance and chromaticity of the display panel 100 to a value (e.g., a required value). The reference gamma voltage is a voltage input to the data driver 220 that generates a data signal for determining a display luminance. The data driver 220 generates a data signal corresponding to the grayscale of input image data, using the reference gamma voltage, and provides the generated data signal to the display panel 100. The light emitting device OLED provided in each pixel PX of the display panel 100 emits light, corresponding to the data signal. The display device programs the reference gamma voltage, so that the display panel 100 can have a target luminance and a target chromaticity.

Next, the display device may set a gamma voltage (e.g., a black voltage) corresponding to a black grayscale (330). For example, the display device may set a gamma voltage corresponding to the black grayscale with respect to each pixel PX. The display device may set not only the black grayscale but also corresponding gamma voltages with respect to preset grayscales that can be expressed by the pixels PX.

Next, the display device may set a driving power voltage, based on a bright spot voltage of the display panel 100 (340).

In some example embodiments of the present disclosure, the controller 250 may provide a black voltage to the display panel 100 through the data driver 220, and measure a current flowing through the display panel 100 while changing the second driving power voltage. The current is a current flowing through the light emitting device OLED provided in each pixel PX of the display panel 100, and may be a current of the second driving power source VSS. The black voltage is a preset gamma voltage corresponding to the black grayscale.

The controller 250 decides a bright spot voltage of the display panel 100, using the current measurement result. The controller 250 may reset the bright spot voltage as the second driving power voltage or set a preset initial second power voltage as a final second driving power voltage, based on a result obtained by comparing the decided bright spot voltage and the preset initial second power voltage.

Hereinafter, the above-described method for setting a driving power voltage of the display device will be described in more detail.

Figure 4:
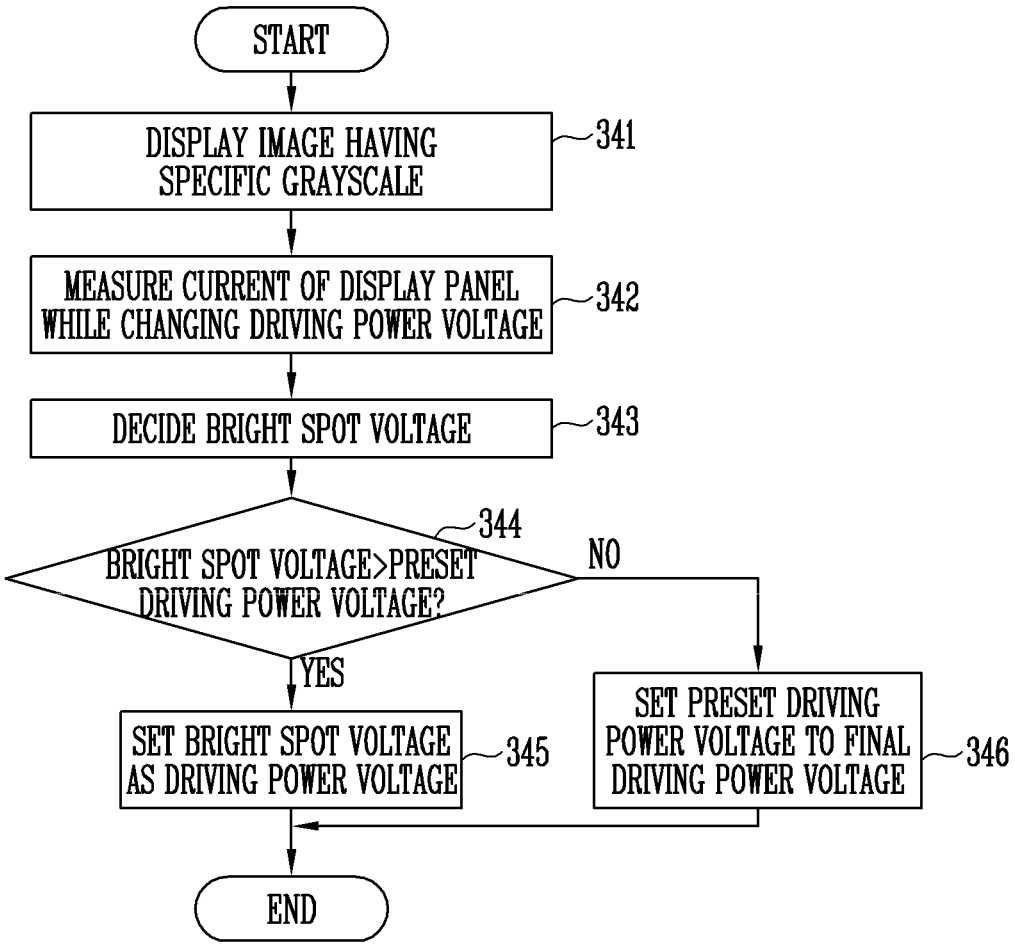
FIG. 4 is a flowchart illustrating a method for determining a driving power voltage according to some example embodiments of the present disclosure.
Figure 5:
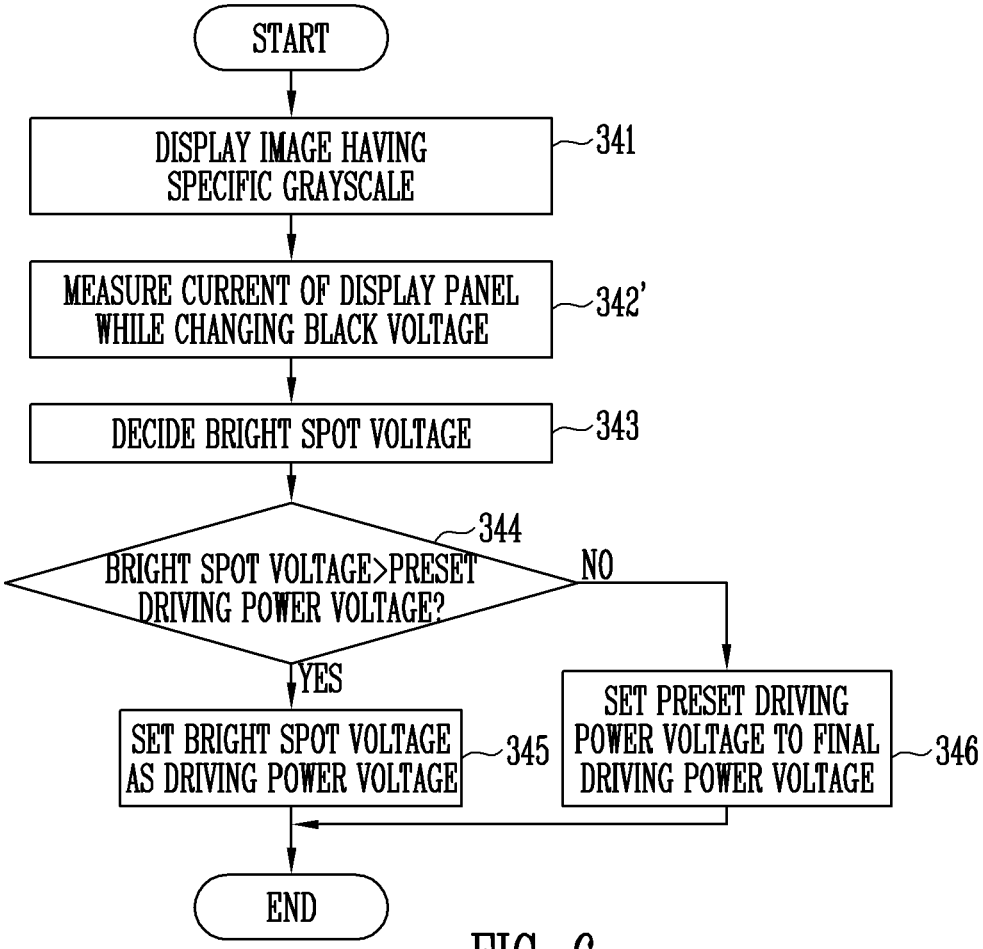
FIG. 5 is a flowchart illustrating a method for determining the driving power voltage according to some example embodiments of the present disclosure.
Figure 6:
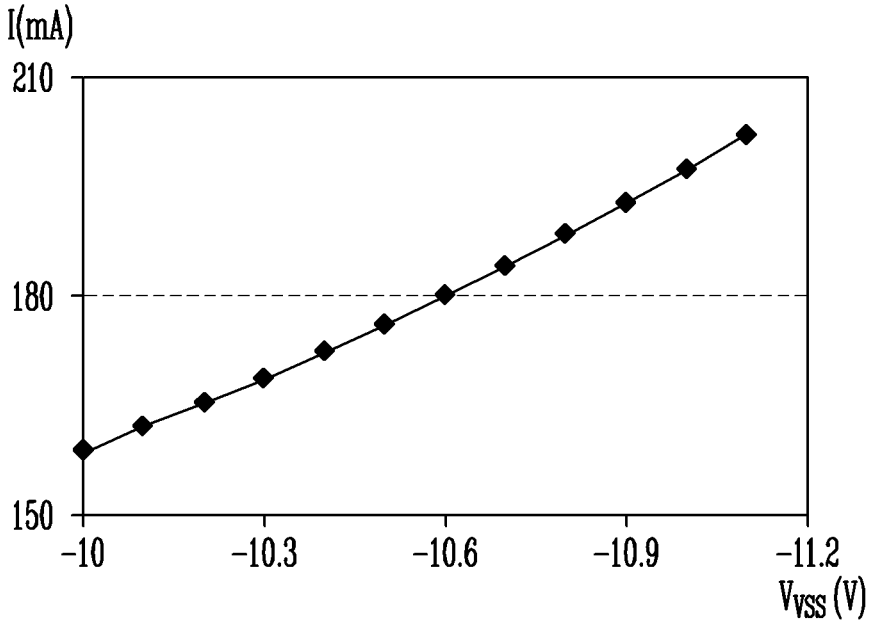
FIGS. 6 to 8 are diagrams illustrating a method for determining the driving power voltage according to some example embodiments of the present disclosure.
Figure 7:
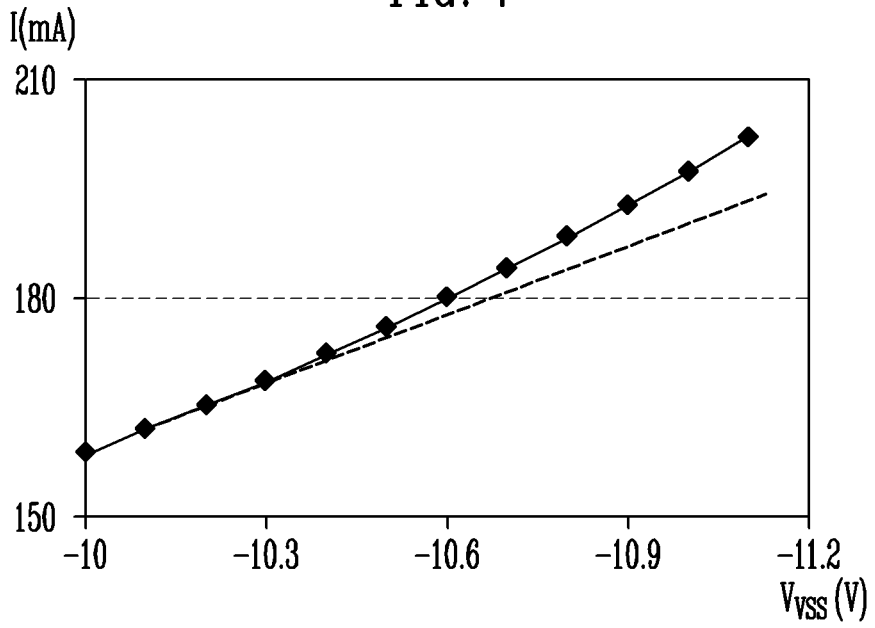
Figure 8:
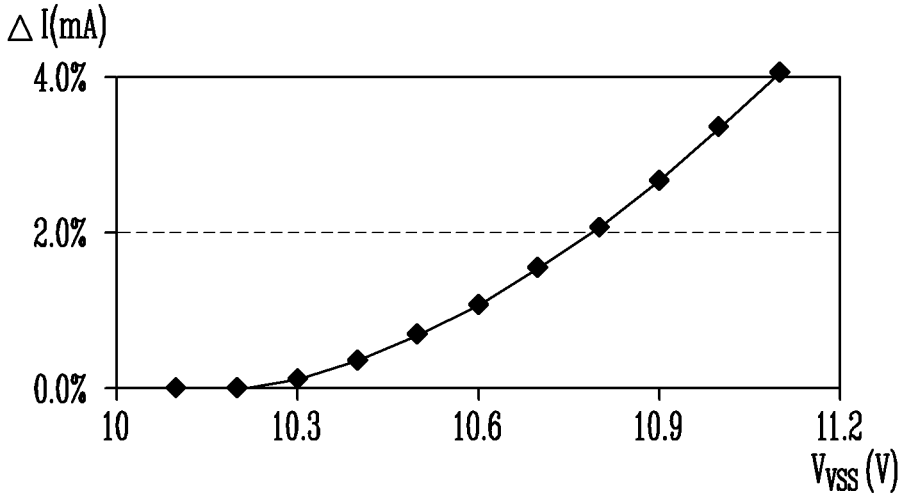

FIG. 4 is a flowchart illustrating in more detail a method for determining a driving power voltage according to some example embodiments of the present disclosure. FIG. 5 is a flowchart illustrating in detail a method for determining the driving power voltage according to some example embodiments of the present disclosure. FIGS. 6 to 8 are diagrams illustrating a method for determining the driving power voltage according to some example embodiments of the present disclosure.

Referring to FIG. 4, first, the display device displays an image having a specific grayscale (341). In an embodiment, the display device may display an image having a black grayscale on the display panel 100. The data driver 220 provides a black voltage to the display panel 100, so that the pixels PX of the display panel 100 can emit light with a luminance corresponding to the black grayscale.

Next, the display device measures a current of the display panel 100 while a driving power voltage is being changed (S342).

In some example embodiments of the present disclosure, the controller 250 of the display device changes (increases and/or decreases) a second driving power voltage supplied from the power supply 240 to the display panel 100 in a preset unit within a threshold range. The threshold range for changing the second driving power voltage may be determined based on an initial driving power voltage. For example, the threshold range may be determined to include an initial second power voltage.

In some example embodiments, when the initial second power voltage is set to −10 V, the display device may change the second driving power voltage supplied to the display panel 100 at an interval of 0.1 V from −10 V to −11.1 V.

While the second driving power voltage supplied to the display panel 100 is being changed, the display device measures a current of the display panel 100. The measured current is a current flowing through the light emitting device OLED provided in each pixel PX. In other words, the measured current may be a current flowing through the second driving power source VSS. The controller 250 may measure a current of the display panel 100 with respect to each second driving power voltage changed in the preset unit. In FIG. 6, a result obtained by measuring a current while the second driving power voltage is being changed at the interval of 0.1 V from −10 V to −11.1 V is illustrated as an example. In an example, the relationship between the second driving power voltage and the measured current may be defined by or approximated to an arbitrary quadratic equation.

However, embodiments according to the present disclosure are not limited thereto. That is, according to some example embodiments of the present disclosure, the display device may measure a change in current according to a data voltage, i.e., a black voltage (e.g., 7 V) corresponding to the black grayscale as shown in FIG. 5 (342'). In the another embodiment, the data driver 220 may change the black voltage in a preset unit within a threshold range, and supply a data signal corresponding to the changed black voltage to the display panel 100. The threshold range may be determined based on a predetermined black voltage. For example, the threshold range may be determined to include the predetermined black voltage.

Next, the display device decides a bright spot voltage of the display panel 100, based on the measured change in current (343).

The controller 250 may decide a reference current according to the second driving power voltage. The reference current may be decided based on the current measured at the initial second power voltage. In some example embodiments, when the relationship between the second driving power voltage and the measured current is defined by an arbitrary quadratic equation, the reference current may be determined by a tangent line of the corresponding quadratic equation at an initial second power voltage. The tangent line at the initial second power voltage may be defined by the following Equation 1.

$$I=a\times(V_{VSS}-V_{VSS_int})+I_0 \quad \text{Equation 1}$$

Here, I is a reference current with respect to the second driving power voltage, $V_{VSS}$ is a second driving power voltage, $V_{VSS_int}$ is an initial second power voltage, $I_0$ is a current measured at the initial second power voltage, and a is a differential value at the initial second power voltage with respect to the quadratic equation.

In FIG. 7, reference currents in the embodiment of FIG. 6 are illustrated as an example. That is, in FIG. 7, a tangent line when the second driving power voltage is −10 V that is the initial second power voltage is illustrated as an example.

The controller 250 compares reference currents and measured currents with reference to second driving power voltages. When the difference between a reference current and a measured current exceeds a preset threshold value as shown in FIG. 8, the controller 250 may decide a corresponding second driving power voltage as a bright spot voltage.

In the present disclosure, the method for deciding a bright spot voltage of the display device is not limited thereto.

When the bright spot voltage is decided, the display device may determine whether the bright spot voltage is larger than a preset driving power voltage by comparing the bright spot voltage and the preset driving power voltage (344). That is, the controller 250 may compare the decided bright spot voltage and the preset second driving power voltage.

When the bright spot voltage is larger than the preset driving power voltage, the display device sets the bright spot voltage as the driving power voltage (345). That is, when the bright spot voltage is larger than the preset driving power voltage, the controller 250 may set the bright spot voltage as a second driving power voltage.

On the contrary, when the bright spot voltage is smaller than or equal to the preset driving power voltage, the display device sets the preset driving power voltage as a final driving power voltage (346). That is, when the bright spot voltage is smaller than or equal to the preset driving power voltage, the controller 250 sets the preset second driving power voltage as a final second driving power voltage.

When the display device is driven by the driving power voltage determined as described above, deterioration of image quality due to occurrence of a bright spot of the display panel 100 can be prevented or reduced, and the yield and reliability of the display device can be improved.

In the display device and the driving method thereof according to the present disclosure, a driving power voltage of the display panel is determined by considering a bright spot, so that incidences of image quality being deteriorated due to occurrence of the bright spot may be prevented or reduced.

Also, in the display device and the driving method thereof according to the present disclosure, an optimized black grayscale voltage is determined, so that the yield and reliability of the display device can be improved.

Example embodiments have been disclosed herein, and although specific terms are employed, they are used and are to be interpreted in a generic and descriptive sense only and not for purpose of limitation. In some instances, as would be apparent to one of ordinary skill in the art as of the filing of the present application, features, characteristics, and/or elements described in connection with a particular embodiment may be used singly or in combination with features, characteristics, and/or elements described in connection with other embodiments unless otherwise specifically indicated. Accordingly, it will be understood by those of skill in the art that various changes in form and details may be made without departing from the spirit and scope of the present disclosure as set forth in the following claims, and their equivalents.

What is claimed is:

1. A display device comprising:

a display panel including a plurality of pixels connected to data lines;

a data driver configured to supply a black voltage corresponding to a black grayscale through the data lines to the display panel; and a controller configured to:

set a second voltage of the display panel to be an initial voltage;

change the second voltage at a preset interval within a threshold range while the data driver is supplying the black voltage to the display panel through the data lines;

measure a current of the display panel corresponding to each change of the second voltage at the preset interval;

decide a bright spot voltage of the display panel; and set any one of the bright spot voltage and the second voltage as a final voltage provided to the display panel, wherein the controller is configured to determine a reference current according to the second voltage, and to decide, as the bright spot voltage, the second voltage when a difference between the reference current and the measured current exceeds a preset threshold value.

2. The display device of claim 1, wherein the threshold range includes the second voltage.

3. The display device of claim 1, wherein, when the measured current is approximated to an arbitrary quadratic equation, the reference current is defined by a tangent line of the quadratic equation at second voltage.

4. The display device of claim 1, wherein the controller is configured to set, as the final voltage, a large voltage between the second voltage and the bright spot voltage.

5. The display device of claim 1, wherein the second voltage is a low-potential voltage.

6. A method for driving a display device having a display panel including a plurality of pixels connected to data lines, the method comprising:

setting a second voltage of the display panel to be an initial voltage;

changing the second voltage at a preset interval within a threshold range while a black voltage corresponding to a black grayscale is being supplied to the display panel through the data lines;

measuring a current of the display panel, corresponding to each change of the second voltage at the preset interval;

deciding a bright spot voltage; and setting any one of a voltage of the bright spot voltage and the second voltage as a final voltage provided to the display panel, wherein the deciding of the bright spot voltage includes:

determining a reference current according to the second voltage;

comparing the reference current and the measured current; and deciding, as the bright spot voltage, the changed second voltage when a difference between the reference current and the measured current exceeds a preset threshold value, based on the comparison result.

7. The method of claim 6, wherein the threshold range includes the second voltage.

8. The method of claim 6, wherein the determining of the reference current includes:

approximating the measured current to an arbitrary quadratic equation; and defining the reference current, based on a tangent line of the quadratic equation at the second voltage.

9. The method of claim 6, wherein the setting of the final voltage includes:

comparing the second voltage and the bright spot voltage;

when second voltage is larger than the bright spot voltage, setting the second voltage as the final voltage; and when the bright spot voltage is larger than the second voltage, setting the bright spot voltage as the final voltage.

10. The method of claim 6, wherein the second voltage is a low-potential voltage.

* * * * *